US006959677B2

(12) United States Patent
Mayer et al.

(10) Patent No.: US 6,959,677 B2
(45) Date of Patent: Nov. 1, 2005

(54) HYDRAULIC SUPPORT ELEMENT

(75) Inventors: Wolfgang Mayer, Seukendorf (DE); Harald Smola, Langenzenn (DE); Klaus Benedikt, Windach (DE); Christian Kunze, Kirchseeon (DE)

(73) Assignee: Ina-Schaeffler KG, (DE)

( * ) Notice: Subject to any disclaimer, the term of this patent is extended or adjusted under 35 U.S.C. 154(b) by 0 days.

(21) Appl. No.: 11/055,268

(22) Filed: Feb. 10, 2005

(65) Prior Publication Data

US 2005/0178351 A1 Aug. 18, 2005

(30) Foreign Application Priority Data

Feb. 12, 2004 (DE) ..... 10 2004 006 903

(51) Int. Cl.[7] ..... F01L 1/18
(52) U.S. Cl. ..... 123/90.45; 123/90.39; 123/90.52

(58) Field of Search ..... 123/90.12, 90.13, 123/90.16, 90.2, 90.39, 90.44, 90.43, 90.45, 123/90.46, 90.48, 90.52, 90.55

(56) References Cited

U.S. PATENT DOCUMENTS 5,325,825 A * 7/1994 Schmidt et al. ..... 123/90.39
5,655,487 A * 8/1997 Maas et al. ..... 123/90.16
6,606,972 B2 * 8/2003 Wenisch et al. ..... 123/90.17

* cited by examiner

*Primary Examiner*—Thomas Denion
*Assistant Examiner*—Ching Chang
(74) *Attorney, Agent, or Firm*—Charles A. Muserlian

(57) ABSTRACT

The invention proposes a hydraulic support element (1) whose high-pressure chamber (10) is kept substantially free of air bubbles and oil foam. This is realized through a deflecting sleeve (15*a*) in combination with two vent bores (16) situated diametrically opposite each other on the inner peripheral surface (17) of the pressure piston (5).

6 Claims, 1 Drawing Sheet

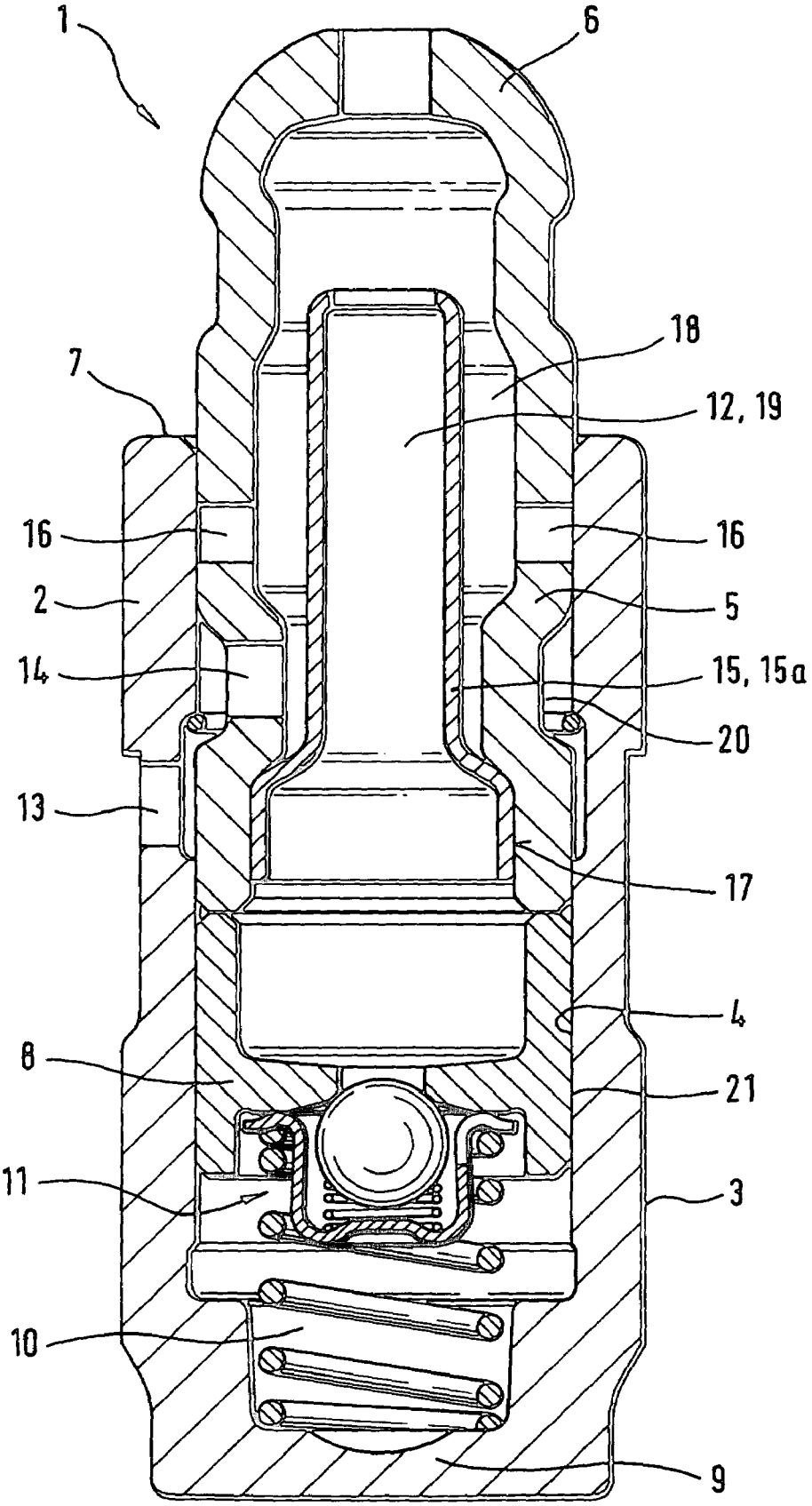
1
6
18
7
12, 19
16
16
2
5
14
15, 15a
20
13
17
4
8
21
11
3
10
9

HYDRAULIC SUPPORT ELEMENT

FIELD OF THE INVENTION

The invention concerns a hydraulic support element for a valve train of an internal combustion engine, said support element comprising a hollow cylindrical housing that can be installed with an outer peripheral surface in a reception of a cylinder head of the internal combustion engine and receives an axially displaceable pressure piston in a bore, a head of said pressure piston extending beyond an edge of the housing, a high-pressure chamber for a hydraulic medium being formed between a front end of the pressure piston oriented away from the head and an underside of the housing, which high-pressure chamber can be closed by a one-way valve that is fixed on said front end and opens in direction of the high-pressure chamber that is supplied with hydraulic medium through the one-way valve from a reservoir enclosed by the pressure piston, said housing comprising at least one radial opening for the hydraulic medium from the cylinder head, said radial opening being in fluid communication radially inwards with at least one passage to the reservoir in the pressure piston, said passage being situated axially above the radial opening of the housing.

In a support element of the pre-cited type known from DE 195 07 240 A1, the hydraulic medium is routed directly from the passage in the pressure piston into the reservoir above the front end of the pressure piston comprising the one-way valve. Practice has shown that in support elements of this type, to put it simply, too many air bubbles and oil foam accumulate in the reservoir so that these are sucked in an undesired manner into the high-pressure chamber during lash adjustment. This leads to an undesired compressibility of the high-pressure chamber so that the pre-defined gas exchange cross-section is not available during cam lift. Due to the direct flow of the hydraulic medium into the reservoir of the pressure chamber, the hydraulic medium already accumulated therein is constantly whirled up anew and, although possibly already degassed or "calmed", it is mixed again with air bubbles and oil foam.

OBJECTS OF THE INVENTION

It is an object of the invention to provide a support element of the pre-cited type in which the aforesaid drawbacks are eliminated with simple measures.

This and other objects and advantages of the invention will become obvious from the following detailed description.

SUMMARY OF THE INVENTION

The invention achieves the above objects by the fact that, a) on the one hand, a fractional quantity of hydraulic medium situated at least directly in front of the one-way valve is separated by a separating means from hydraulic medium entering through the passage, and that, b) on the other hand, the pressure piston comprises at least one vent bore situated axially above the passage but within the housing.

It is precisely through a combination of the measures just mentioned that the initially described drawbacks are effectively avoided. The separating means configured preferably as a deflecting sleeve constitutes a so-called dead or "resting" room for the hydraulic medium in front of the one-way valve. New inflowing air bubbles and oil foam can no longer whirl up or influence anew the already "calmed" hydraulic medium situated in front of the one-way valve. A fractional quantity of air bubbles and oil foam can thus escape upwards relatively undisturbed out of the deflecting sleeve in a direction opposite to the direction of gravity. A further quantity of undesired air in the hydraulic medium stream is routed, already before its actual ingress into the interior of the deflecting sleeve, into the open through the at least one vent bore that is situated axially above the passage in the pressure piston. It is exactly with this combined effect (deflecting sheet+vent bore) that it is achieved that the high-pressure chamber remains substantially incompressible because the undesired air can no longer be sucked in there.

In a preferred embodiment of the invention, the pressure piston comprises two vent bores situated diametrically opposite each other, so that even if the hydraulic support element is installed in an inclined position, it is always guaranteed that at least one vent bore is situated at a relatively very high level as viewed in the direction of the force of gravity.

It is also possible to use other means as separating means in place of the circumferentially continuous deflecting sleeve. These can be constituted by baffle plates or the like for the hydraulic medium and are arranged downstream of the passage in the pressure piston in the direction of flow, so that at least a direct impact of the hydraulic medium stream on the hydraulic medium situated in front of the one-way valve, and already "calmed", is avoided.

The rising path for the hydraulic medium on the inner peripheral surface of the pressure piston may, of course, be configured as a channel, but a configuration in the form of a circumferentially continuous annular channel is more appropriate because, in this way, a relatively large quantity of hydraulic medium can be accumulated in the support element.

A further feature of the invention concerns a simple measure for fixing the deflecting sleeve on the inner peripheral surface of the pressure piston. This can be done, for instance, by snapping-in or clipping-on the sleeve on the inner peripheral surface of the pressure piston. Other alternative, appropriate methods for this purpose are, for instance, welding, gluing, soldering and the like. The deflecting sleeve is preferably made of a light-weight material like sheet metal, but it is also conceivable to make the sleeve out of plastic.

The annular groove in the outer peripheral surface of the pressure piston comprising the passage can be fabricated in a rather simple manner. This dispenses with the need of an anti-rotation means and a controlled positioning of the passage relative to the radial opening.

The housing advantageously has a pot-like geometry and is closed in the region of its underside by a bottom. It may, however, also have an open configuration, in which case, the pressure chamber is delimited on one side by a bottom of the bore of the cylinder head.

BRIEF DESCRIPTION OF THE DRAWING

The invention is described more closely below with reference to the appended drawing. The sole FIGURE shows a longitudinal section through a hydraulic support element comprising the features of the invention.

DETAILED DESCRIPTION OF THE DRAWING

The FIGURE discloses a hydraulic support element 1 as is known, per se, in the technical field with regard to its construction and mode of functioning.

The support element 1 comprises a hollow cylindrical housing 2 which is fixed through its outer peripheral surface 3 in a reception, not shown, of a cylinder head of the internal combustion engine. The support element 1 may also be installed in an inclined position. A thin-walled pressure piston 5 is received in a bore 4 of the housing 2 for axial displacement relative to the housing 2. A head 6 of the pressure piston 5 extends beyond an edge 7 of the housing 2.

A high-pressure chamber 10 for the hydraulic medium is defined between a front end 8 (here, an annular surface) of the pressure piston 5 oriented away from the head 6 and an underside 9 of the housing 2. A one-way valve 11 extends on an undersurface of the front end 8, the valve body of this one-way valve 11 being spring-biased towards the front end 8.

Axially above the front end 8, the pressure piston 5 encloses a reservoir 12 for hydraulic medium. The high-pressure chamber 10 is thus supplied with hydraulic medium from the reservoir 12, via the one-way valve 11, as needed.

The person skilled in the art will further see from the FIGURE that a radial opening 13 for hydraulic medium extends through the housing wall. This radial opening 13 communicates with a hydraulic medium duct in the cylinder head. The hydraulic medium is routed further from the radial opening 13 into an annular groove 20 in the outer peripheral surface 21 of the pressure piston 5. This annular groove 20 is situated axially above the radial opening 13 and comprises at least one passage 14 to the interior of the pressure piston 5.

At the same time, a separating means 15 is fixed axially below the passage 14 on the inner peripheral surface 17 of the pressure piston 5. In the present case, the separating means 15 is configured as a deflecting sleeve 15*a*. In this way, starting from the passage 14, an annular rising path 18 for the hydraulic medium is created downstream of the passage 14.

In the region of the head 6, on which the end of a finger lever is supported, the hydraulic medium is routed into an inner space 19 enclosed by the deflecting sleeve 15*a*. This inner space 19 thus constitutes the actual reservoir 12 of the pressure piston 5. In a manner, known per se, the hydraulic medium is further routed from this inner space 19 through the one-way valve 11 into the high-pressure chamber 10.

It can be further seen that two vent bores 16 situated diametrically opposite each other are arranged axially above the passage 14 but below the edge 7. These vent bores 16 are therefore situated in the region of the rising path 18.

Precisely because of the use of the deflecting sleeve 15*a* as a separating means 15 in combination with the aforesaid vent bores 16, the excellent combined effect is achieved that the high-pressure chamber 10 remains substantially free of oil foam and air bubbles, and the support element 1 is thus not compressible in an undesired manner during cam lift.

Following the ingress of the hydraulic medium through the passage 14 of the pressure piston 5, a first quantity of air is already routed indirectly into the open through the vent bores 16. At the same time, the hydraulic medium accumulated directly above the one-way valve 11 is in a relatively calmed state within the deflecting sleeve 15*a*. This is due to the fact that this hydraulic medium is no longer whirled up and thus influenced by the hydraulic medium flowing in through the radial opening 13. Should the hydraulic medium routed through the rising path 18 into the inner space 19 of the deflecting sleeve 15*a* still contain air bubbles or dissolved air, this air ascends little by little and does not influence the relatively "calm" hydraulic medium situated directly in front of the one-way valve 11.

What is claimed is:

1. A hydraulic support element for a valve train of an internal combustion engine, said support element comprising a hollow cylindrical housing that can be installed with an outer peripheral surface in a reception of a cylinder head of the internal combustion engine and receives an axially displaceable pressure piston in a bore, a head of said pressure piston extending beyond an edge of the housing, a high-pressure chamber for a hydraulic medium being formed between a front end of the pressure piston oriented away from the head and an underside of the housing, which high-pressure chamber can be closed by a one-way valve that is fixed on said front end and opens in direction of the high-pressure chamber that is supplied with hydraulic medium through the one-way valve from a reservoir enclosed by the pressure piston, said housing comprising at least one radial opening for the hydraulic medium from the cylinder head, said radial opening being in fluid communication radially inwards with at least one passage to the reservoir in the pressure piston, said passage being situated axially above the radial opening of the housing, wherein, a) on the one hand, a fractional quantity of hydraulic medium situated at least directly in front of the one-way valve is separated by a separating means from hydraulic medium entering through the passage, and, b) on the other hand, the pressure piston comprises at least one vent bore situated axially above the passage but within the housing.

2. A support element of claim 1, wherein the pressure piston comprises at least two vent bores that are circumferentially equally spaced from each other.

3. A support element of claim 1, wherein the separating means is configured as a deflecting sleeve for the hydraulic medium and is sealingly fixed axially below the passage on an inner peripheral surface of the pressure piston while extending to near the head of the pressure piston, a rising path for the hydraulic medium being arranged between the deflecting sleeve and an inner peripheral surface of the pressure piston, which hydraulic medium is routed in a region of the head into an inner space of the deflecting sleeve actually constituting the reservoir, so that the hydraulic medium accumulates directly in front of the one-way valve.

4. A support element of claim 3, wherein the deflecting sleeve is made as a thin-walled light-weight component, typically as a sheet metal component, and is fixed on the inner peripheral surface of the pressure piston by one of snapping-in, welding or gluing.

5. A support element of claim 3, wherein the rising path is configured as a circumferentially continuous annular channel.

6. A support element of claim 1, wherein the passage in the pressure piston is situated in an annular groove in the outer peripheral surface of the pressure piston.

* * * * *